US006853122B2

(12) United States Patent
Miyamoto et al.

(10) Patent No.: US 6,853,122 B2
(45) Date of Patent: Feb. 8, 2005

(54) CATHODE-RAY TUBE APPARATUS

(75) Inventors: Noriyuki Miyamoto, Iruma-gun (JP); Tsutomu Takekawa, Fukaya (JP); Hirofumi Ueno, Fukaya (JP); Masatane Jida, Himeji (JP); Kazunori Satou, Fukaya (JP); Tomonari Ishihara, Fukaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 41 days.

(21) Appl. No.: 09/881,825

(22) Filed: Jun. 18, 2001

(65) Prior Publication Data

US 2003/0205961 A1 Nov. 6, 2003

(30) Foreign Application Priority Data

Jun. 19, 2000 (JP) ..... 2000-183195

(51) Int. Cl.[7] ..... H01J 29/48; H01J 29/62
(52) U.S. Cl. ..... 313/414; 313/409
(58) Field of Search ..... 313/412–414, 313/409, 448, 449, 425, 428, 421, 432, 439, 458; 335/210–213

(56) References Cited

U.S. PATENT DOCUMENTS 4,086,513 A * 4/1978 Evans, Jr., deceased .... 313/414
4,366,414 A * 12/1982 Hatayama et al. ..... 313/409
4,701,678 A * 10/1987 Blacker et al. ..... 315/382
4,772,827 A * 9/1988 Osakabe ..... 315/382
5,061,881 A * 10/1991 Suzuki et al. ..... 315/382
5,113,112 A * 5/1992 Shimoma et al. ..... 313/412
5,162,695 A * 11/1992 Shimona et al. ..... 313/412
5,539,278 A * 7/1996 Takahashi ..... 315/14
5,677,590 A * 10/1997 Matsuda et al. ..... 313/412
5,814,929 A * 9/1998 Jo ..... 313/414
5,990,637 A * 11/1999 Cho ..... 315/382
6,031,326 A * 2/2000 Suzuki et al. ..... 313/414
6,455,995 B1 * 9/2002 Jang et al. ..... 313/414

FOREIGN PATENT DOCUMENTS

JP 62-21216 5/1987
JP 10-172464 6/1998

* cited by examiner

*Primary Examiner*—Joseph Williams
*Assistant Examiner*—Dalei Dong
(74) *Attorney, Agent, or Firm*—Oblon, Spivak, McClelland, Maier & Neustadt, P.C.

(57) ABSTRACT

At least one of the electrodes of an electron gun assembly is constructed by coupling at least first and second electrode members arranged in a direction of passing of electron beams. The first electrode member has a projecting portion on an end face thereof, which is to be coupled to the second electrode member disposed adjacent to the first electrode member. The first electrode member is coupled to the second electrode member via the projecting portion.

8 Claims, 4 Drawing Sheets

G3

CATHODE-RAY TUBE APPARATUS

CROSS-REFERENCE TO RELATED APPLICATIONS

This application is based upon and claims the benefit of priority from the prior Japanese Patent Application No. 2000-183195, filed Jun. 19, 2000, the entire contents of which are incorporated herein by reference.

BACKGROUND OF THE INVENTION

The present invention relates generally to a cathode-ray tube apparatus, and more particularly to a color cathode-ray tube apparatus equipped with a velocity modulation coil.

There is known a practically used color cathode-ray tube apparatus equipped with a velocity modulation coil for clarifying the contour of an image. The velocity modulation coil is mounted on an outer surface of a neck located behind a deflection yoke, thereby to enhance the sharpness of an image.

The velocity modulation coil may be disposed at any position where electron beams will pass, if the whole system is considered. It is necessary, however, to dispose it where no interference of generated magnetic fields will occur between itself and the deflection yoke. Accordingly, there is no choice but to dispose the velocity modulation coil at a predetermined position on the cathode side of an anode electrode.

Taking the above into account, the velocity modulation coil is normally disposed around a location where a focus electrode is provided. In this case, however, the frequency of current flowing in the velocity modulation coil is high, and a magnetic field generated from the velocity modulation coil causes an eddy current in the focus electrode. Since the eddy current suppresses generation of a magnetic flux of the velocity modulation coil, which acts in the focus electrode, the velocity modulation effect is disadvantageously reduced.

In order to intensify the magnetic field of the velocity modulation coil, two methods are available: to increase the current flowing in the velocity modulation coil, or to increase the number of turns of the velocity modulation coil. In the case of the former, the diameter of wire of the coil needs to be increased, and a greater power consumption is required to supply a greater current. As a result, a load on the circuit, as well as the cost, will increase. In the case of the latter, the thickness of the velocity modulation coil increases, and the adjustment performance for a purity convergence magnet deteriorates. Although the magnetic field can theoretically be intensified by adjusting the position of the velocity modulation coil, the position of the coil cannot freely be changed because of positioning restrictions on actual design, as mentioned above. Besides, in general terms, if a magnetic field for correcting the contour of an image is intensified by some method, the action of the magnetic field on electron beams increases and the amount of a leak magnetic field also increases. Consequently, a problem of an electromagnetic wave fault may arise.

On the other hand, there are known electron gun structures, as disclosed in Jpn. Pat. Appln. KOKOKU Publication No. 62-21216, etc., which embody a method of causing a magnetic field of the velocity modulation coil to effectively act on electron beams, without intensifying this magnetic field. In these structures, an electrode in a region where the velocity modulation coil is positioned, which is normally a single electrode or an integral electrode of tightly welded plural electrode components, is divided into electrode members with spaces provided thereamong, and these electrode members are electrically connected by means of lead wire.

The spaces among the divided electrode members of the electrode function to suppress an eddy current caused in the electrode by the magnetic field of the velocity modulation coil, and to let the magnetic field of the velocity modulation coil permeate into the electrode and act on the electron beams, thus enhancing the velocity modulation effect. In this method, however, a welding work for lead wire is necessary in order to electrically connect the electrode members of the electrode. There is a possibility of a problem of work efficiency and deformation of the electrode members at the time of welding lead wire. Moreover, since the electrode members are spaced apart, the strength of holding of the electrode members may become deficient, the electrode members may be displaced relative to the axial direction, or the electric field from the inner wall of the neck may permeate.

Jpn. Pat. Appln. KOKAI Publication No. 10-172464, etc. disclose electron gun structures as other countermeasures. In the methods according to these countermeasures, slits are formed in an electrode in a region where the velocity modulation coil is positioned. The slits function to suppress an eddy current caused in the electrode, and to let the magnetic field of the velocity modulation coil permeate into the electrode via the slits and act on the electron beams, thus enhancing the velocity modulation effect. In these methods, however, the formation of the slits may decrease the strength of the electrode, degrade the precision in dimension of the electrode, e.g. circularity of electron beam passage holes, and give rise to deformation of the electrode at the time of assembly.

As has been mentioned above, in order to obtain an image with high sharpness, it is necessary to cause the magnetic field of the velocity modulation coil to effectively act on the electron beams. However, this magnetic field causes an eddy current in the electrode of the electron gun assembly, and the eddy current suppresses the magnetic field of the velocity modulation coil and degrades the velocity modulation effect.

In order to solve these problems, there are the prior-art methods wherein an electrode in a region where the velocity modulation coil is positioned, which is normally a single electrode or an integral electrode of tightly welded plural electrode components, is divided into electrode members with spaces provided thereamong, and these electrode members are electrically connected by means of lead wire, or wherein slits are formed in an electrode in a region where the velocity modulation coil is positioned. These methods, however, have the problems in that the precision in dimension of the electrode deteriorates or the electrode may deform due to the decrease in strength of the electrode, and the electric field of the neck may permeate.

BRIEF SUMMARY OF THE INVENTION

The present invention has been made in consideration of the above problems, and an object of the invention is to provide a cathode-ray tube apparatus capable of suppressing a decrease in velocity modulation effect, without increasing a magnetic field of a velocity modulation coil. Another object of the invention is to provide a cathode-ray tube apparatus capable of providing an image with high sharpness while preventing a decrease in the precision of dimension of an electrode of an electron gun assembly and deformation of the electrode, without degrading the strength of the electrode and the work efficiency of assembling the electrode.

The present invention provides a cathode-ray tube apparatus comprising:

an electron gun assembly having a plurality of electrodes constituting an electron beam generating section for generating electron beams and a main lens section for focusing the electron beams, which have been generated from the electron beam generating section, onto a phosphor screen;

a deflection yoke for generating deflection magnetic fields for deflecting the electron beams emitted from the electron gun assembly in a horizontal direction and a vertical direction of the phosphor screen, and causing the electron beams to scan the phosphor screen in the horizontal and vertical directions; and velocity modulation coils for modulating scan velocities of the electron beams, wherein at least one of the electrodes of the electron gun assembly is constructed by coupling at least first and second electrode members arranged in a direction of passing of the electron beams, and the first electrode member has a projecting portion on an end face thereof, which is to be coupled to the second electrode member disposed adjacent to the first electrode member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of a cathode-ray tube apparatus according to the present invention will now be described with reference to the accompanying drawings.

Figure 1:
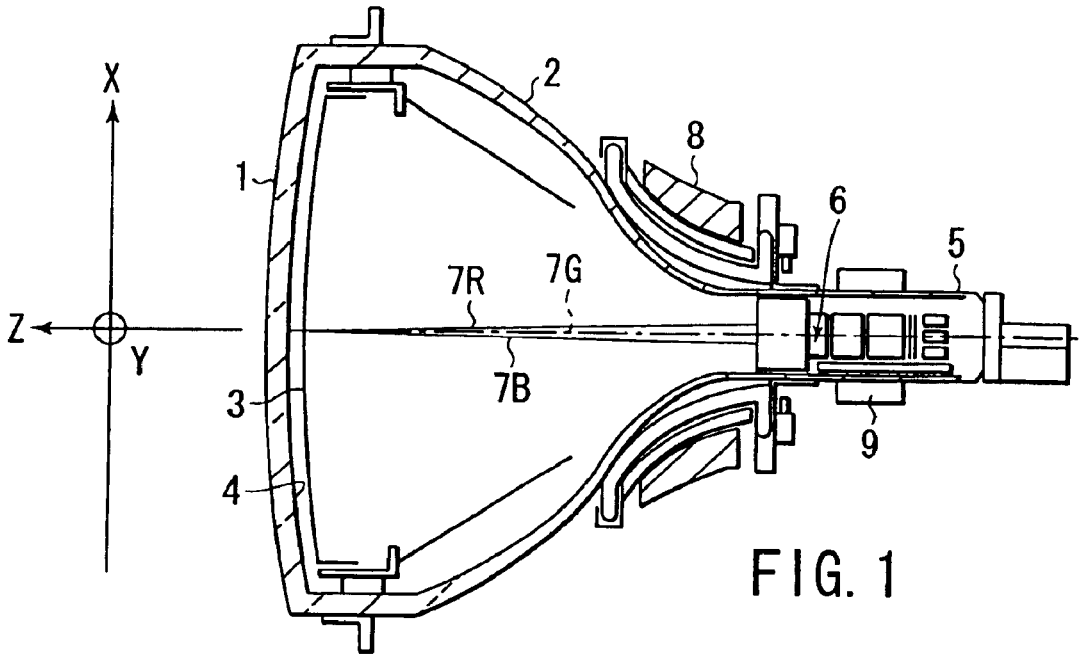
FIG. 1 is a horizontal cross-sectional view schematically showing an example of the structure of a cathode-ray tube apparatus of the present invention.

As is shown in FIG. 1, the cathode-ray tube apparatus of the present invention, for example, a self-convergence type in-line color cathode-ray tube apparatus, comprises an envelope formed of a panel 1, a neck 5 and a funnel 2 integrally coupled to the panel 1 and neck 5. The panel 1 has a phosphor screen 4 on its inner surface. The phosphor screen 4 comprises stripe-shaped or dot-shaped three-color phosphor layers that emit blue, green and red light. A shadow mask 3, which has many apertures therein, is disposed to face the phosphor screen 4. An in-line electron gun assembly 6 is included in the neck 5. The electron gun assembly 6 emits three electron beams 7B, 7G and 7R arranged in line, i.e. a center beam 7G and a pair of side beams 7B and 7R passing in the same horizontal plane. A deflection yoke 8 is mounted on that portion of the funnel 2, which extends between a large-diameter portion of the funnel 2 and the neck 5. The deflection yoke 8 generates non-uniform deflection magnetic fields for deflecting the three electron beams 7B, 7G and 7R from the electron gun assembly 6 in a horizontal direction (X) and a vertical direction (Y). The non-uniform deflection magnetic fields comprise a pin-cushion-shaped horizontal deflection magnetic field and barrel-shaped vertical deflection magnetic field. The cathode-ray tube apparatus has a pair of velocity modulation coils 9 mounted on an outer surface of the neck 5 behind the deflection yoke 8. As is shown in FIG. 1, the velocity modulation coils 9 are horizontally disposed to be opposed to each other.

The three electron beams 7B, 7G and 7R emitted from the electron gun assembly 6 are deflected by the non-uniform magnetic fields generated by the deflection yoke 8 and caused to scan the phosphor screen 4 via the shadow mask 3 in the horizontal direction X and vertical direction Y. Thereby, a color image is displayed.

Figure 6:
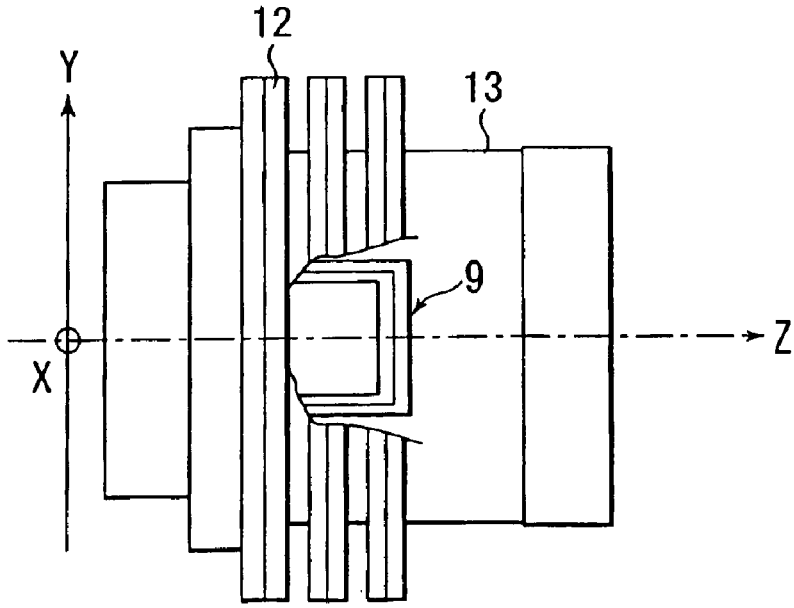
FIG. 6 shows the disposition of a velocity modulation coil applied to the cathode-ray tube apparatus shown in FIG. 1.

For reasons of the outside space of the neck 5, the velocity modulation coils 9 applied to this cathode-ray tube apparatus are attached inside a cylindrical support 13 for supporting a purity convergence magnet 12, as shown in FIG. 6. A pair of annular purity adjustment magnets and two pairs of annular convergence adjustment magnets, which constitute the purity convergence magnet 12, are rotatably disposed around the velocity modulation coils 9.

The velocity modulation coils 9 operate, as will be described below.

Figure 7A:
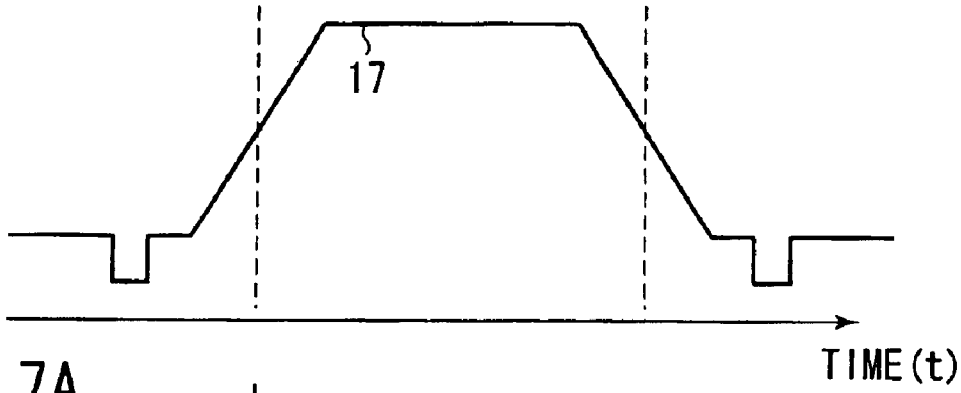
FIGS. 7A to 7D illustrate the operation of the velocity modulation coil.
Figure 7B:
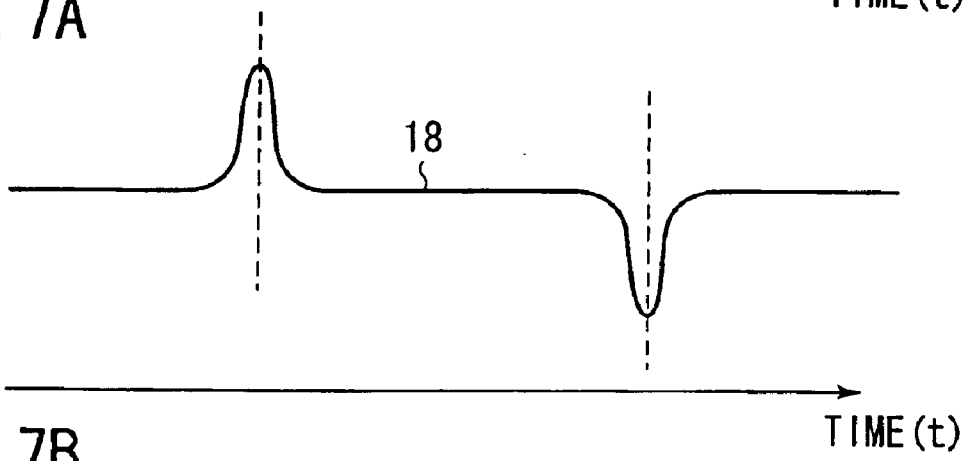
Figure 7C:
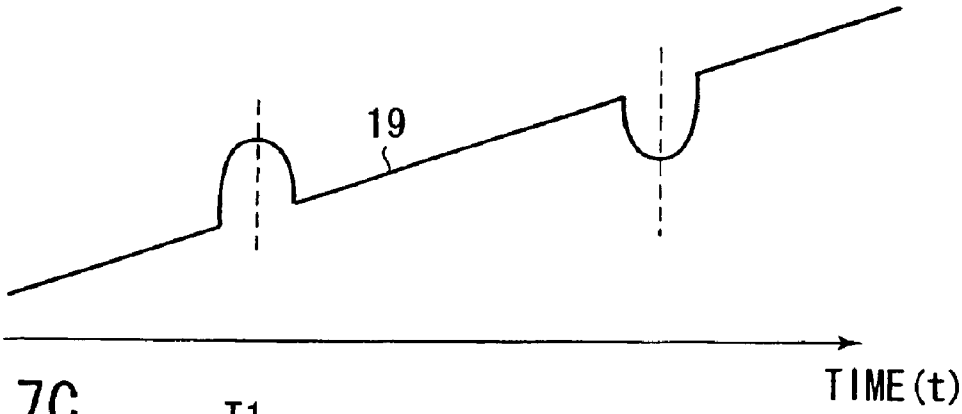
Figure 7D:
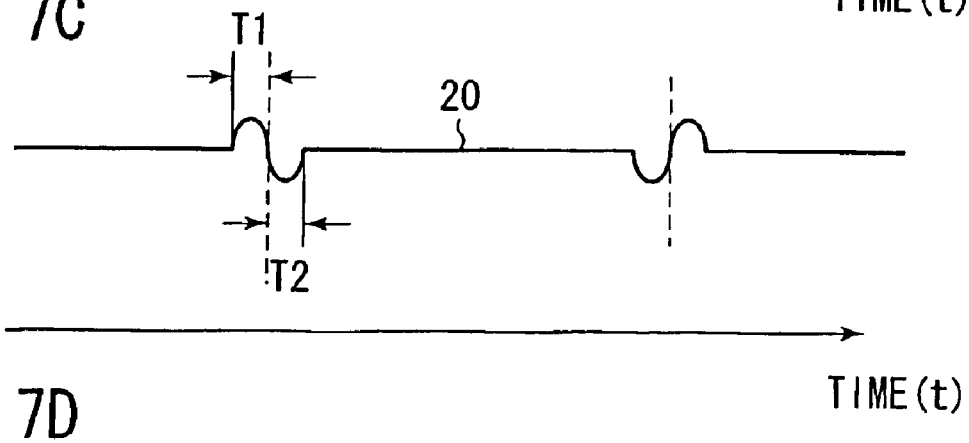

A video signal 17 with a waveform shown in FIG. 7A is subjected to first-order differentiation. Thus, a pulse current 18 having peaks at a rising portion and a falling portion of the video signal, as shown in FIG. 7B, is obtained. The pulse current 18 is supplied to the velocity modulation coils 9, thereby causing the velocity modulation coils 9 to generate a magnetic field. The magnetic field generated by the velocity modulation coils 9 is combined with the horizontal deflection magnetic field generated by the deflection yoke 8, and a composite magnetic field 19, as shown in FIG. 7C, is formed. If the composite magnetic field 19 is subjected to first order differentiation, a curve 20 shown in FIG. 7D is obtained. The scan velocity of a horizontally deflected electron beam is proportional to the variation of the magnetic field. Accordingly, the horizontal scan velocity of the electron beam varies, as indicated by the curve 20. Specifically, in a first halftime period T1 of the rising portion (changing from black to white) of the video signal, the scan velocity is increased to lower the luminance of the image. In a second halftime period T2, the scan velocity is decreased to raise the luminance of the image. In the falling portion (changing from white to black) of the video signal, the scan velocity varies reverse to the case of the rising portion.

Thereby, the contours of the rising and falling portions of the display image are corrected, and the sharpness of the image is enhanced.

Figure 2:
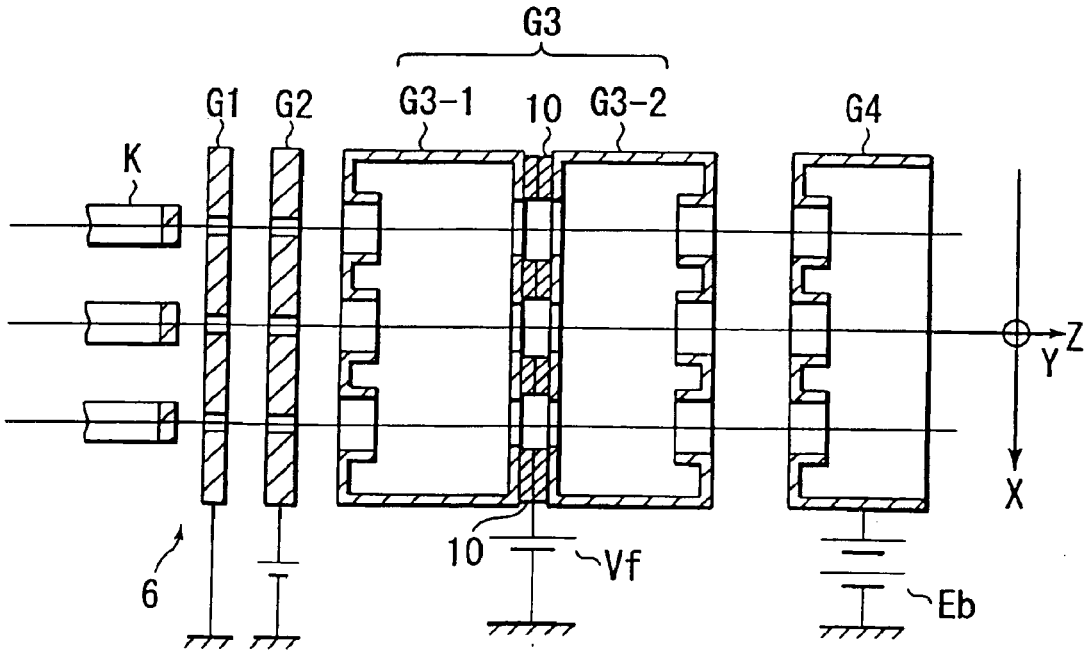
FIG. 2 is a horizontal cross-sectional view showing an example of an electron gun assembly applied to the cathode-ray tube apparatus shown in FIG. 1.

As is shown in FIG. 2, the electron gun assembly 6 comprises three cathodes K arranged in line in the horizontal direction X, three heaters (not shown) for individually heating the cathodes K, and four grids, i.e. a first grid G1, a second grid G2, a third grid G3 and a fourth grid G4. The four grids are successively arranged in a tube axis direction Z from the cathodes K toward the phosphor screen 4. The third grid G3 comprises a first segment G3-1 and a second segment G3-2, which are arranged in the named order from the cathode K side. The heaters, cathodes K and the four grids are integrally fixed by a pair of insulating supports.

Each of the first and second grids G1 and G2 is composed of a plate-like electrode with an integral structure. The plate-like electrode has three circular electron beam passage holes horizontally arranged in line in association with the three cathodes K.

The third grid G3 functioning as a focus electrode is constructed by coupling a plurality of electrode members, that is, the mutually adjacent first segment G3-1 and second segment G3-2. The first segment G3-1 and second segment G3-2 are composed of cylindrical electrodes, respectively. Each cylindrical electrode has three circular electron beam passage holes horizontally arranged in line in association with the three cathodes K.

The fourth grid G4 functioning as an anode electrode is composed of a cup-shaped electrode. The cup-shaped electrode has, in its surface facing the third grid G3, three circular electron beam passage holes horizontally arranged in line in association with the three cathodes K.

The velocity modulation coils 9 are mounted on an outer surface of the neck at a region where the third grid G3 is disposed.

In the electron gun assembly having the above-described structure, a voltage obtained by superimposing a modulation signal corresponding to the video signal on a DC voltage of about 100V to 200V is applied to the cathodes K. The first grid G1 is grounded. A DC voltage of about 500V to 1000V is applied to the second grid G2. A constant focus voltage Vf of about 6 kV to 10 kV is applied to the third grid G3. An ultimate acceleration voltage Eb of about 22 kV to 35 kV is applied to the fourth grid G4.

The cathodes K, first grid G1 and second grid G2 constitute an electron beam generating section for generating electron beams. The second grid G2 and third grid G3 constitute a prefocus lens for prefocusing the electron beams generated from the electron beam generating section. The third grid G3 and fourth grid G4 constitute a main lens for ultimately focusing the prefocused electron beams on the phosphor screen.

Figure 3A:
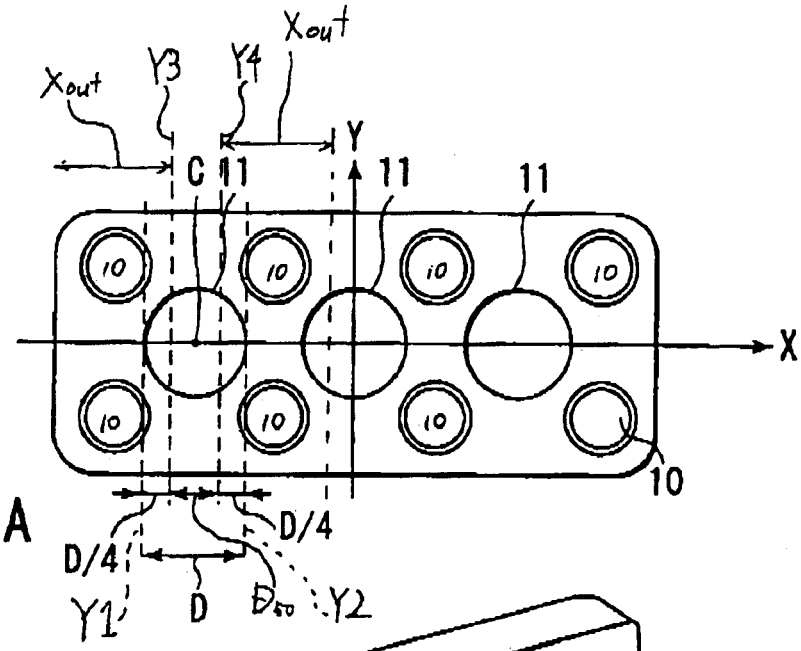
FIG. 3A is a plan view schematically showing the structure of an electrode member applied to a third grid of the electron gun assembly shown in FIG. 2.
Figure 3B:
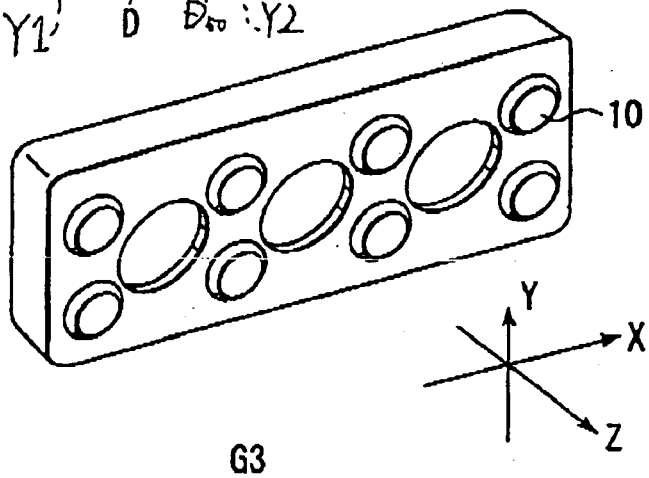
FIG. 3B is a perspective view schematically showing the structure of the electrode member shown in FIG. 3A.

The first segment G3-1 and second segment G3-2 of the third grid G3 have a plurality of projecting portions 10 at their mutually coupled end faces, as shown in FIGS. 3A and 3B. Specifically, the first segment G3-1 has plural projecting portions 10 at its end face opposed to the second segment G3-2. The second segment G3-2 has plural projecting portions 10 at its end face opposed to the first segment G3-1 such that these projecting portions 10 correspond to the projecting portions 10 of the first segment G3-1. The first segment G3-1 and second segment G3-2 are coupled by welding their projecting portions 10.

The projecting portions 10 of these electrode members are formed at regions where the magnetic field generated by the velocity modulation coils 9 does not act on the electron beams. Referring to FIG. 3A, assume that a maximum diametrical dimension of the electron beam passage hole 11 in the horizontal direction including the center axis C of the passage hole 11 is 100%. If each projecting portion 10 is formed within a predetermined region (where the electron beam will mainly pass) corresponding to 50% of the maximum diametrical dimension (100%), with the center of this 50% dimension being set at the center axis C of the passage hole 11, the eddy current suppression effect will gradually decrease as the location of the projecting portion 10 becomes closer to the center axis C. If each projecting portion 10 is formed in a region outside the 50% dimension, the eddy current suppression effect will gradually increase as it is located away from the region of 50% dimension. In short, if the maximum horizontal diametrical dimension of the electron beam passage hole 11 is D, it is desirable that the projecting portion 10 be located within a region corresponding to D/4 from the end of the passage hole 11 toward the center axis C.

Thereby, the projecting portion 10 does not block the passage of the magnetic field acting on the electron beam in the vertical direction Y, which passes through the electron beam passage hole 11. Accordingly, the magnetic field generated by the velocity modulation coils 9 can be made to effectively act on the electron beams, and degradation of the velocity modulation effect can be suppressed.

In this case, the effect of suppressing the eddy current due to the magnetic field generated by the velocity modulation coils 9 was increased 1.3 times, compared to the case of a color CRT apparatus in which electrode members are not coupled by means of the projections 10.

As has been described above, since the electrodes of the electron gun assembly have the above-described structure, the generation of the eddy current in the electrode due to the magnetic field from the velocity modulation coils 9 can be suppressed. The magnetic field generated by the velocity modulation coils 9 can easily permeate through the gaps between the electrode members coupled by means of the projecting portions 10, and it effectively acts on the electron beams. Thus, a sufficient velocity modulation effect can be obtained. Moreover, there is no need to modify the conventional assembly steps of the electron gun assembly. Since the electrode members constituting the electrode are machined and directly coupled, the mechanical strength of the electrode can be increased, and misalignment of the electrode members relative to the tube axis can be prevented. Furthermore, there is no need to perform lead wire welding for electrically connecting the divided electrode members, which may result in deformation of the electrode. Besides, the projecting portions formed on the electrode members can suppress permeation of the neck electric field.

Another embodiment of the invention will now be described.

Figure 4:
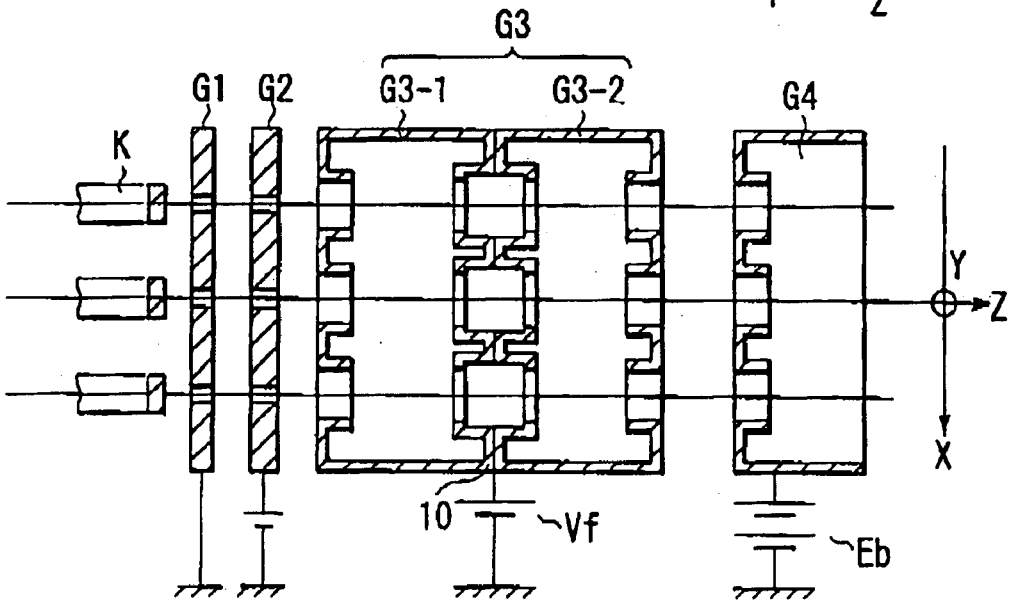
FIG. 4 is a horizontal cross-sectional view showing another example of the electron gun assembly applied to the cathode-ray tube apparatus shown in FIG. 1.

As is shown in FIG. 4, the electron gun assembly of this embodiment is substantially the same as the electron gun assembly shown in FIG. 2 except for the structure of the third grid G3. Accordingly, the common structural elements are denoted by like reference numerals and a detailed description thereof is omitted.

Figure 5A:
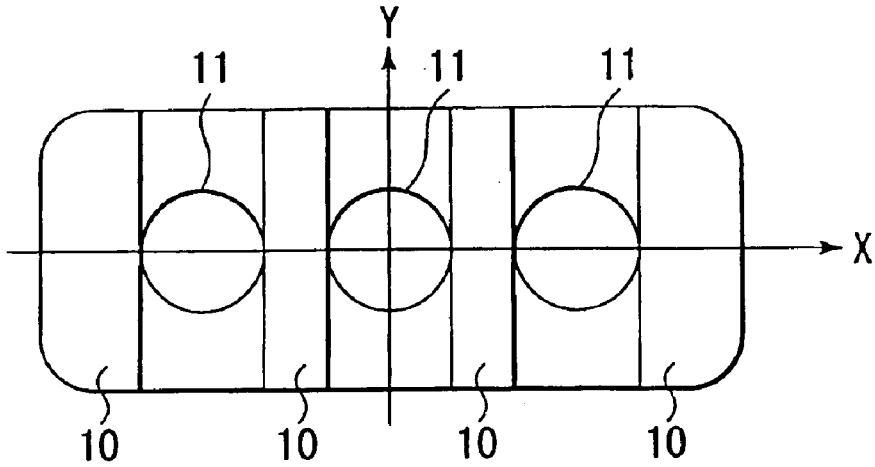
FIG. 5A is a plan view schematically showing the structure of an electrode member applied to a third grid of the electron gun assembly shown in FIG. 4.
Figure 5B:
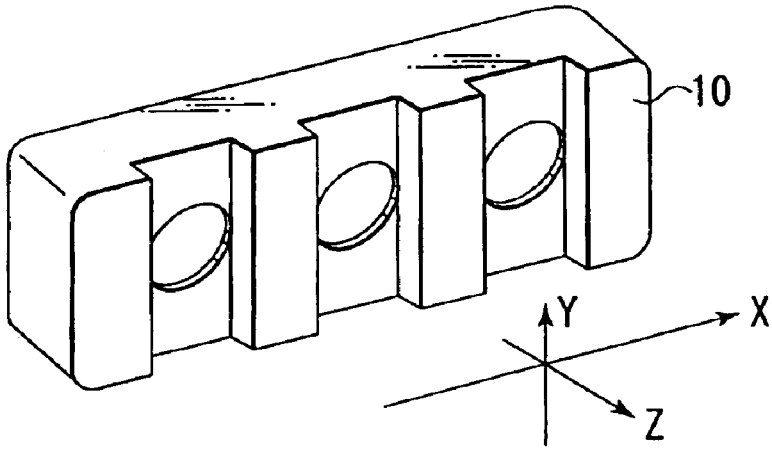
FIG. 5B is a perspective view schematically showing the structure of the electrode member shown in FIG. 5A.

In the preceding embodiment, the projecting portions 10 are formed in truncated conical shapes at predetermined regions. In the present embodiment, as shown in FIGS. 5A and 5B, the projecting portions 10 are formed in stripe shapes on both sides of each electron beam passage hole 11. The stripe-shaped projecting portions 10, too, are disposed outside the regions where the magnetic field generated by the velocity modulation coils 9 acts on the electron beams.

With this structure, the eddy current caused in the third grid G3 by the magnetic field from the velocity modulation coils 9 can be reduced by the coupling portion with the projecting portions 10 within the third grid G3. Part of the magnetic field from the velocity modulation coils 9 permeates into the third grid G3 through the gaps at the coupling portion, thereby acting on the electron beams and achieving an effective velocity modulation action. Thus, degradation in velocity modulation effect can be suppressed and an image with high sharpness can be obtained.

In the above-described embodiments, only one coupling interface is provided between the electrode members with the projecting portions within the electrode. However, if the number of electrode members can be increased within the tolerable design range of the electrode length, the number of coupling interfaces may be increased accordingly. In the embodiments, the projecting portions provided at the coupling interface are formed on both the electrode members to be coupled. However, the projecting portions provided at the coupling interface may be formed on only one of the electrode members to be coupled. There is no need to couple the electrode members using the projecting portions formed on both the coupling surfaces of the electrode members. The electrode members may be coupled using the projecting portions formed on one of the coupling surfaces of the electrode members.

The above-described embodiments are directed to color cathode-ray tube apparatuses each having a bi-potential electron gun assembly. However, the present invention is applicable to various types of color cathode-ray tube apparatuses having a uni-potential electron gun assembly, a bi-potential/uni-potential composite electron gun assembly, and a high-uni-potential electron gun assembly, etc.

As has been described above, the present invention can provide a cathode-ray tube apparatus capable of suppressing a decrease in velocity modulation effect, without increasing a magnetic field of a velocity modulation coil. This invention can also provide a cathode-ray tube apparatus capable of providing an image with high sharpness while preventing a decrease in the precision of dimension of an electrode of an electron gun assembly and deformation of the electrode, without degrading the strength of the electrode and the work efficiency of assembling the electrode.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode-ray tube apparatus comprising:

an electron gun assembly having a plurality of electrodes constituting an electron beam generating section for generating electron beams and a main lens section for focusing the electron beams, which have been generated from the electron beam generating section, onto a phosphor screen;

a deflection yoke for generating deflection magnetic fields for deflecting the electron beams emitted from the electron gun assembly in a horizontal direction and a vertical direction of the phosphor screen, and causing the electron beams to scan the phosphor screen in the horizontal and vertical directions; and velocity modulation coils, provided as a separate body from the deflection yoke, and outside the electron gun assembly, for modulating scan velocities of the electron beams in synchronism with deflection magnetic fields generated by the deflection yoke, wherein at least one of the electrodes of the electron gun assembly is constructed by bringing at least first and second electrode members arranged in a direction of passing of the electron beams in physical contact with each other, the first electrode member has a projecting portion on an end face thereof, which is to be in physical contact with the second electrode member disposed adjacent to the first electrode member, the first electrode member has electron beam passage holes for passing of the electron beams, and the projecting portion is formed such that when a maximum diametrical dimension of each electron beam passage hole in a horizontal direction including a center axis of the electron beam passage hole is set at 100%, the projecting portion is formed in a region other than a region corresponding to 50% of the maximum diametrical dimension, with the center of this 50% dimension being set at the center axis of the electron beam passage hole, and said projecting portion is formed in a region other than a region where a magnetic field generated from the velocity modulation coils acts on the electron beams.

2. A cathode-ray tube apparatus according to claim 1, wherein the second electrode member has a projecting portion on an end face thereof, which is to be in physical contact with the first electrode member, such that the projecting portion of the second electrode member corresponds to the projecting portion of the first electrode member.

3. A cathode-ray tube apparatus according to claim 1, wherein the electrode constructed by bringing said at least first and second electrode members in physical contact with each other is the electrode constituting said main lens section.

4. A cathode-ray tube apparatus according to claim 1, comprising:

a gap formed between said end face and said second electrode member.

5. A cathode-ray tube apparatus according to claim 1, comprising:

said first electrode member makes physical contact with said second electrode member only with said projecting portion.

6. A cathode-ray tube apparatus according to claim 2, comprising:

a gap formed between said end face of said first electrode member and said end face of said second electrode member.

7. A cathode-ray tube apparatus according to claim 2, comprising:

said projecting portion of said first electrode member in physical contact with said projecting portion of said second electrode member.

8. A cathode-ray tube apparatus according to claim 2, comprising:

physical contact between said first electrode member and said second electrode member occurs only between said respective projecting portions.

* * * * *